US006095701A

United States Patent [19]

Sattler

[11] Patent Number: 6,095,701

[45] **Date of Patent: *Aug. 1, 2000**

[54] ADJUSTABLE PRINT HEAD MOUNTING MECHANISM

[75] Inventor: Ronald L. Sattler, Bloomington, Minn.

[73] Assignee: Datacard Corporation, Minneapolis, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/997,183

[22] Filed: Dec. 23, 1997

[51] Int. Cl.[7] ..... B41J 2/335

[52] U.S. Cl. ..... 400/120.17; 347/198

[58] Field of Search ..... 400/120.16, 120.17, 400/175, 120.01; 347/197, 198, 223

[56] References Cited

U.S. PATENT DOCUMENTS

| | | | |
|---|---|---|---|
| 3,845,850 | 11/1974 | Herr et al. | 101/93.04 |
| 4,179,210 | 12/1979 | Bestenreiner et al. . | |
| 4,495,507 | 1/1985 | Moriguchi et al. . | |
| 4,570,168 | 2/1986 | Sjordal et al. | 400/55 |
| 4,594,597 | 6/1986 | Lin et al. . | |
| 4,694,305 | 9/1987 | Shiomii et al. . | |
| 4,707,706 | 11/1987 | Nagano . | |
| 4,844,632 | 7/1989 | Minowa | 400/120.17 |
| 4,857,941 | 8/1989 | Kaida . | |
| 4,860,028 | 8/1989 | Ogawa | 347/198 |
| 5,051,009 | 9/1991 | Sugiura et al. | 347/198 |
| 5,160,205 | 11/1992 | Mistyurik | 400/120.16 |
| 5,189,477 | 2/1993 | Leys et al. . | |
| 5,366,302 | 11/1994 | Masumura et al. | 347/197 |
| 5,440,328 | 8/1995 | Nardone et al. . | |
| 5,528,277 | 6/1996 | Nardone et al. . | |
| 5,546,115 | 8/1996 | Nardone et al. . | |
| 5,546,116 | 8/1996 | Nardone et al. . | |
| 5,600,362 | 2/1997 | Morgavi et al. . | |
| 5,610,649 | 3/1997 | Kokubo . | |
| 5,674,013 | 10/1997 | Koike et al. | 400/120.16 |
| 5,694,159 | 12/1997 | Kajiya et al. | 347/197 |
| 5,806,996 | 9/1998 | Leys et al. | 400/120.16 |

FOREIGN PATENT DOCUMENTS

| | | |
|---|---|---|
| 0 388 684 A2 | 9/1990 | European Pat. Off. . |
| 0 672 533 A2 | 9/1995 | European Pat. Off. . |

OTHER PUBLICATIONS

Sep. 1996 "An Introduction to Digital Color Printing", AGFA Education Publishing, pp. 2–5.

*Primary Examiner*—Ren Yan
*Attorney, Agent, or Firm*—Merchant & Gould P.C.

[57] ABSTRACT

The present invention provides a printhead assembly having an adjustable printhead, preferably a thermal printhead, to permit precise positioning of the printhead. The printhead assembly includes a support base upon which a slide assembly is slideably disposed. The slide assembly is slideable along a linear path that is generally parallel to the support base, with movement of the slide assembly along the linear path being controlled by an actuating means. A printhead is mounted on the slide assembly and is moveable therewith along the linear path. The printhead is mounted so as to be adjustable in at least three directions relative to the slide assembly. Preferably, the printhead is: a) pivotable about a first horizontal axis extending perpendicular to the linear path; b) pivotable about a second horizontal axis extending perpendicular to first horizontal axis and parallel to the linear path; and c) moveable in a vertical direction perpendicular to the first and second horizontal axes.

13 Claims, 3 Drawing Sheets

ADJUSTABLE PRINT HEAD MOUNTING MECHANISM

FIELD OF THE INVENTION

This invention relates to printheads, and more particularly to an adjustable thermal printhead for use in a color printer to allow precise positioning of the printhead after the printhead is mounted in the printer.

BACKGROUND OF THE INVENTION

In order to perform printing on a print media, such as plastic cards, paper, and the like, printers are known that include a print assembly with a thermal printhead mounted thereon and a print ribbon disposed between the thermal printhead and the print media. The thermal printhead is selectively moveable on the print assembly to bring the thermal printhead and print ribbon into contact with the print media, to thereby print onto the print media. In order to ensure accurate and high quality printing, the thermal printhead must be precisely positioned on the print assembly in order to achieve proper alignment of the thermal printhead relative to the print media when the thermal printhead is brought into contact therewith.

Typically, proper positioning of thermal printheads is performed by the manufacturer during assembly of the printers, with the thermal printheads being locked in position once the desired position is achieved. Each printer, however, is generally used for a different purpose, such that the position of the printhead(s) in one printer is not the same as the position of the printhead(s) in another printer. Although the printer can be manufactured with the printhead (s) being properly positioned based upon the particular end use of the printer and based upon information provided by the intended user, often times it is found that the exact position has not been achieved once the printer, or the printhead assembly, is positioned within its actual operating environment. Therefore, it would be desirable to be able to adjust the printhead(s) at the location where the printer is to be used, in order to achieve precise positioning of the printhead(s).

Further, since thermal printheads are prone to wear, they need periodic replacement with new thermal printheads. However, printhead replacement may alter the positioning of the printhead, requiring that the replacement printhead be properly positioned. Therefore, it would also be beneficial to be able to replace a printhead without altering the precise positioning thereof.

What is needed then is a printhead assembly in which the thermal printhead can be simply and easily positioned after assembly of the printer and at the location of use of the printer, and which allows printhead replacement without altering the position of the printhead.

SUMMARY OF THE INVENTION

The present invention provides a printhead assembly having an adjustable printhead, preferably a thermal printhead, to permit precise positioning of the printhead. The printhead assembly is useful in any printer having a printhead which must be accurately positioned to ensure precise and high quality printing on a print medium; however the printhead assembly described herein is particularly useful in color printers that perform color printing on plastic cards, such as credit cards, identification cards, and the like.

A preferred embodiment of the printhead assembly in accordance with the principles of the present invention includes a support base upon which a slide assembly is slideably disposed. The slide assembly is slideable along a linear path that is generally parallel to the support base, with movement of the slide assembly along the linear path being controlled by an actuating means. A printhead is mounted on the slide assembly and is moveable therewith along the linear path. The printhead is mounted so as to be adjustable in at least three directions relative to the slide assembly.

In a more preferred embodiment of the present invention, the actuating means includes a pinion gear engaged with a rack mounted on the slide assembly, with the pinion gear being driven by a motor mounted on the support base. Further, the printhead is mounted on a horizontally disposed pivot shaft extending perpendicular to the linear path, with the printhead being pivotable about the pivot shaft. A mechanism is also provided for adjusting the printhead in a vertical direction generally perpendicular to the linear path and to the pivot shaft. Another mechanism is provided to adjust the angular orientation of the printhead by pivoting the printhead about a horizontal axis extending parallel to the linear path and perpendicular to the vertical direction and the pivot shaft. Reference buttons are also provided on a printhead support assembly upon which the printhead is mounted, with the reference buttons ensuring proper placement of the printhead on the pivot shaft. Therefore, the printhead is fully adjustable after the printhead assembly is mounted in the printer, whereby precise positioning of the printhead can be quickly and easily achieved.

In another embodiment of the invention, the printhead is mounted on a heat sink block, and set screws are provided for contacting the top and bottom of the printhead to apply a pressure thereto. Typically, thermal printheads are manufactured with a slight curvature thereto which must be eliminated to ensure a proper printing operation. By applying a pressure to the top and bottom ends of the printhead using the set screws, the curvature in the printhead can be eliminated.

These and various other advantages and features of novelty which characterize the invention are pointed out with particularity in the claims annexed hereto and forming a part hereof. However, for a better understanding of the invention, its advantages and objects attained by its use, reference should be made to the drawings which form a further part hereof, and to the accompanying description, in which there is described a preferred embodiment of the invention.

DETAILED DESCRIPTION OF THE PREFERRED EMBODIMENT

Figure 1:
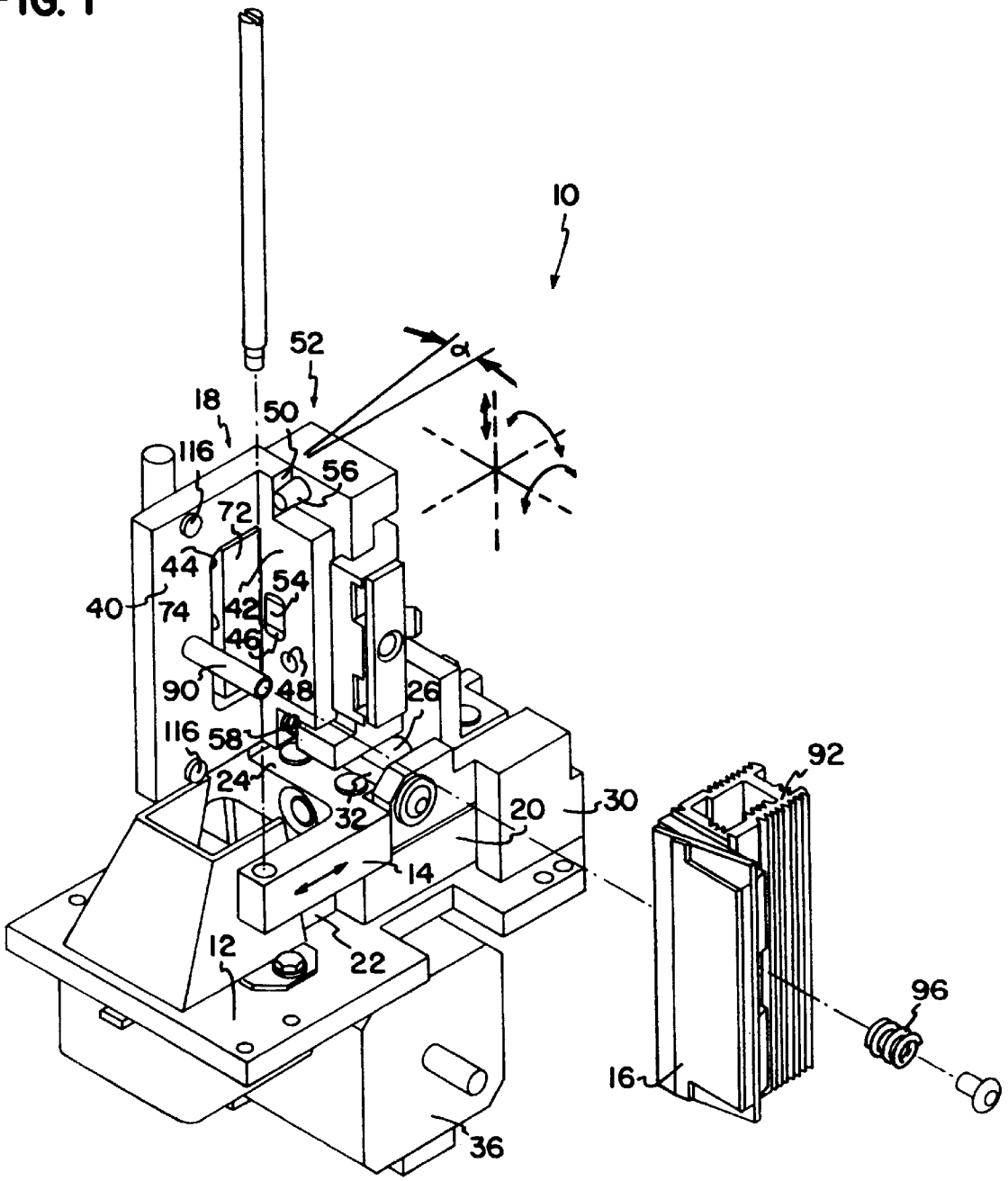
FIG. 1 is an elevated front perspective view of a printhead assembly, with the printhead and heat sink block being detached therefrom.
Figure 2:
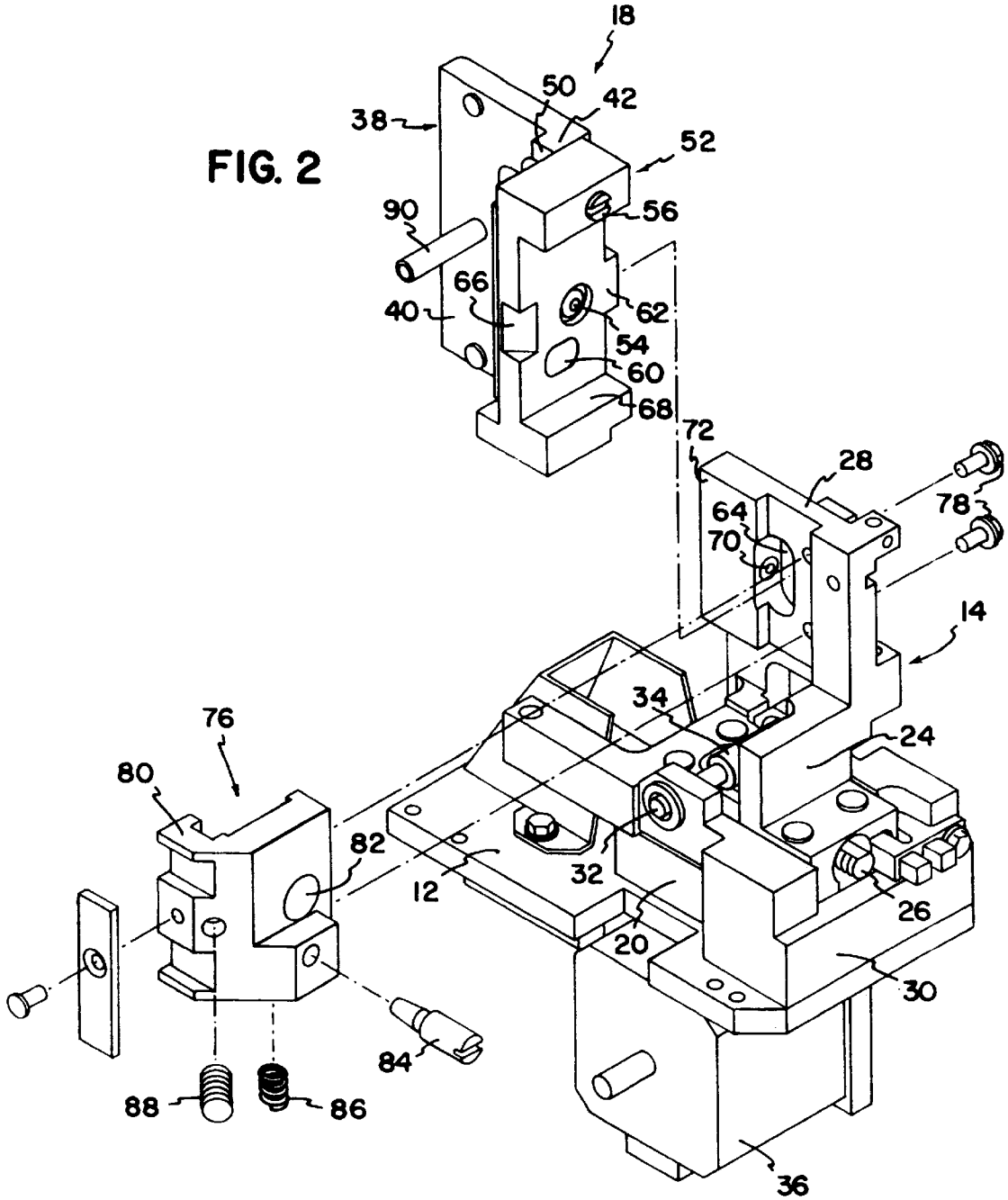
FIG. 2 is an elevated rear perspective view of the printhead assembly, showing the connection between certain elements thereof.

Referring now to FIGS. 1 and 2, a printhead assembly 10 in accordance with the present invention is illustrated. The printhead assembly 10 includes a generally planar, rigid support base or plate 12 which is fixed in any suitable manner within a printer in which the printhead assembly is used. A slide assembly 14 is slideably disposed for sliding movement relative to the base 12 along a linear path that is generally parallel to the base 12, and a printhead 16 is mounted on the slide assembly 14 by a printhead support assembly 18 whereby the printhead 16 moves integrally with the slide assembly during its movements along the linear path.

The slide assembly 14 includes a slide block 20 which is disposed for linear sliding movements upon a fixed guide block 22 secured to the base 12. The slide block 20 preferably includes a channel formed in the bottom thereof which receives the fixed guide block 22, with the slide block 20 being slideable on the guide block 22 in both forward and rearward directions. A slide member 24 is secured to the top surface of the slide block 20 such that the slide member and the slide block move together. A toothed rack 26 is mounted within a bottom portion of the slide member 24, with the rack 26 extending generally parallel to the path of movement of the slide assembly 14. The slide member 24 further includes a vertically extending wall 28 upon which the printhead support assembly 18 is mounted.

A pinion mount structure 30 is fixed to the base 12 and generally surrounds a rear end of the slide block 20 and the slide member 24. A pinion shaft 32 is rotatably supported by the mount structure 30 at its forward end, and a pinion gear 34 is fixed to the shaft 32 in driving engagement with the rack 26. A reversible drive motor 36, such as a stepper motor, is mounted on the bottom of the base 12, with the shaft 32 being driveably connected to the motor 36 in any suitable manner, whereby the motor is able to rotate the shaft and thus the pinion gear 34 connected thereto, thus forming an actuating means for moving the slide assembly 14 along the linear path. As the pinion gear 34 is rotated by the motor, it engages with the rack 26. Since the pinion gear 34 is mounted on the fixed mount structure 30, rotation of the pinion gear causes the rack 26, and thus the entire slide assembly 14, to move either forward or backward on the base 12 depending upon the direction of rotation of the pinion gear. Since the printhead 16 is mounted on the slide assembly 14, it moves therewith along the linear path. In this manner, the printhead 16 can be moved into contact with, or disengaged from, the print media as is required during printing operations on the print media.

As stated previously, the printhead support assembly 18 is mounted upon the vertically extending wall 28 of the slide member 24. The printhead support assembly 18 includes a first, L-shaped portion 38 having a wall 40 extending parallel to the direction of movement of the slide assembly 14, and a wall 42 extending perpendicular to the wall 40. The wall 40 has a cut-out hole 44 adjacent the juncture with the wall 42, with the wall 42 including a vertically elongated pivot hole 46 and a hole 48 disposed beneath and to the side of the pivot hole 46. The wall 42 further includes cut-out sections adjacent the top and bottom ends thereof, with the top cut-out section defining a tapered surface 50 which tapers or angles rearwardly by the amount $\alpha$ relative to an axis parallel to the rack 26.

The printhead support assembly 18 further includes a second portion 52 which is disposed behind the wall 42, and is pivotally connected thereto by a pivot pin 54 such that the first portion 38 can pivot relative to the second portion 52. The pivot pin 54 is configured to generally match the shape of the vertically elongated pivot hole 46. A tapered, threaded screw 56 extends through a threaded hole in the upper end of the second portion 52, and into engagement with the tapered surface 50. As the screw 56 is rotated, it is either advanced or withdrawn relative to the second portion, depending upon the direction of rotation of the screw, thereby advancing or withdrawing the tapered portion of the screw on the tapered surface 50. Due to the tapered construction of the surface 50 and screw 56, advancement of the tapered portion relative to the surface 50 causes the L-shaped portion 38 to pivot relative to the second portion 52 about the axis of the pivot pin 54. A coil spring 58 is disposed in the bottom cut-out section of the wall 42, where it is engaged between the wall 42 and a bottom end of the second portion 52 to continuously bias the L-shaped portion 38 about the axis of the pivot pin 54, opposite the direction of pivoting movement caused by the tapered surface 50 and tapered screw 56. Thus, as the screw 56 is withdrawn, thereby withdrawing the tapered portion thereof relative to the surface 50, the spring 58 biases the L-shaped portion 38 about the pivot pin, thereby maintaining contact between the tapered surface 50 and the tapered screw. The tapered surface and the tapered screw thereby form a mechanism by which the printhead 16 can be angularly adjusted about the axis of the pivot pin, with the axis of the pivot pin being generally parallel to the linear path.

The second portion 52 further includes a tapered pocket 60 formed therein, forming part of a mechanism to allow vertical adjustment of the printhead support assembly 18. A tab 62 is also formed on the second portion 52 and is sized so as to be receivable in a hole 64 formed in the wall 28. The second portion 52 also includes an angled preload surface 66 and a biasing surface 68, the purposes of which will become apparent later in the description. Preferably, a preloading ball plunger 70 is disposed within the hole 64 for applying a preload to the front side of the tab 62.

When assembled, the tab 62 of the second portion 52 is disposed within the hole 64 in the wall 28, with an enlarged portion 72 of the wall 28 being disposed within the hole 44 in the wall 40. The ball plunger 70 applies a preload to the front side of the tab 62 to prevent inadvertent movement of the second portion 52 relative to the wall 28.

A mounting bracket 76 is fixed to the wall 28 by fasteners 78, with the mounting bracket 76 including a hook 80 formed at one side edge to receive an edge of the second portion 52 therein, as seen in FIG. 1. The bracket 76 further includes a hole 82 to allow access to the pivot pin 54, and a tapered, threaded screw 84, similar to the tapered screw 56, extends and into the tapered pocket 60, where the tapered portion of the screw 84 contacts the top surface of the pocket 60. Further, a biasing spring 86 is engaged between the bottom of the bracket 76 and the biasing surface 68 of the second portion 52 to bias the second portion 52 downward. It should be apparent that by advancing the screw 84 relative to the pocket 60, the tapered portion of the screw contacts the pocket thereby forcing the second portion 52 and the L-shaped portion 38 vertically upward against the bias of the spring 86. Retraction of the screw 84 withdraws the tapered portion thereof relative to the tapered pocket, with the bias spring 86 forcing the second portion 52 downward, thereby maintaining contact at all times between the tapered pocket 60 and the tapered portion of the screw 84. The hook 80 permits vertical sliding movements of the second portion 52 relative thereto, while maintaining the vertical alignment of the second portion.

A preload ball plunger 88, similar to the ball plunger 70, extends through the bracket 76 and into engagement with the angled preload surface 66 to apply a preload to the second portion 52 to prevent inadvertent movements thereof.

Thus, the printhead support assembly 18 is mounted on the slide member 24 and moves therewith along the linear path. The combination of the tab 62, bracket 76, and the various ball plungers 70,88 allow the assembly 18 to be mounted on the slide member for movement therewith, with all backlash removed in the direction of the printing force, while ensuring that the assembly 18 can be adjusted relative to the slide member to permit adjustments to the position of the printhead 16.

Figure 3:
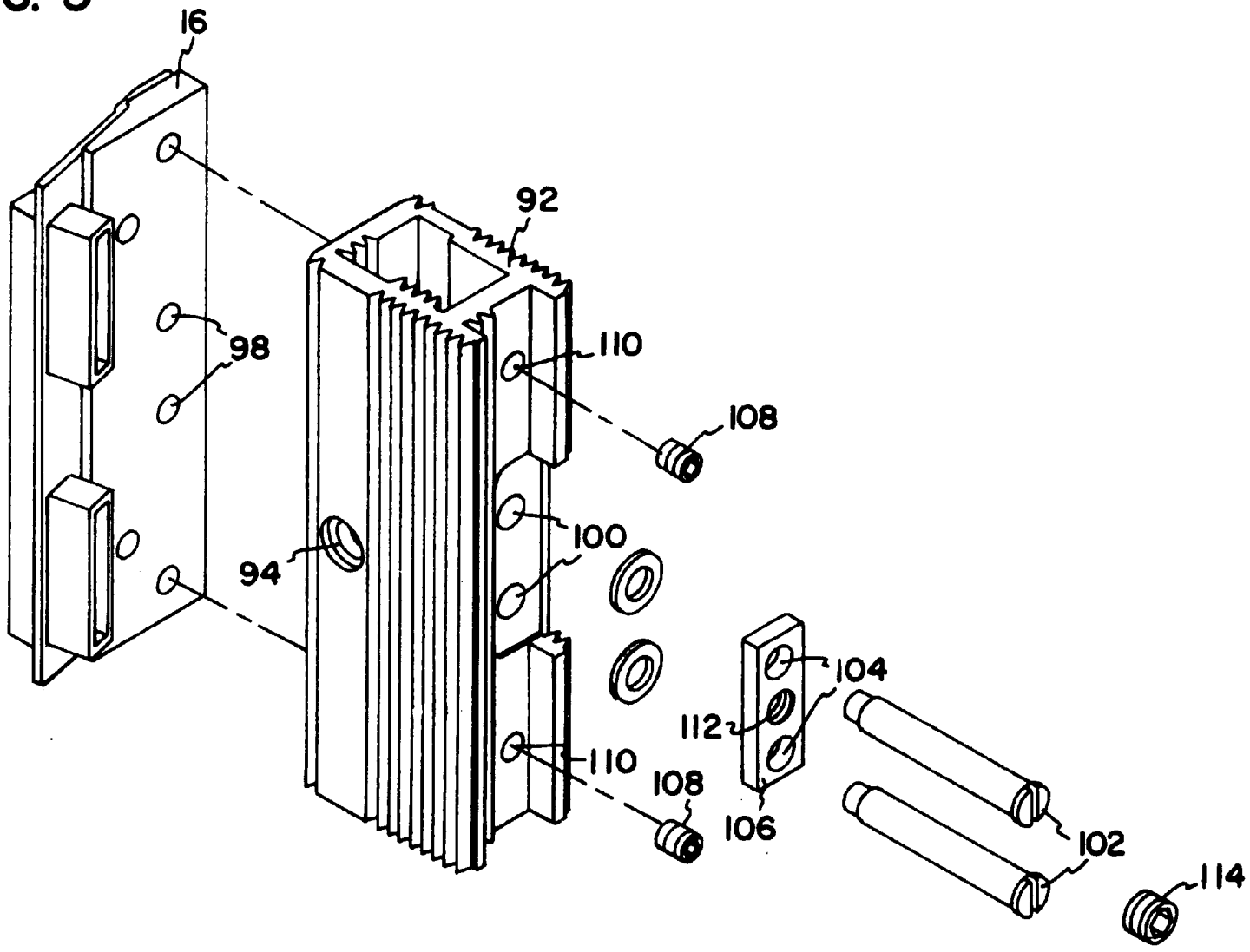
FIG. 3 is an exploded view illustrating how the printhead is mounted on the heat sink block.

Turning now to the specific mounting arrangement of the printhead 16, it can be seen in FIGS. 1 and 2 that a pivot shaft 90 extends from the wall 40 generally in a horizontal direction perpendicular to the linear path and the axis of the pivot pin 54. As shown in FIGS. 1 and 3, the printhead 16 is fixed to a conventional heat sink block 92 having a hole 94 formed therein to allow mounting of the heat sink block on the pivot shaft 90. A coil spring 96 is disposed around the pivot shaft 90 and contacts the side of the heat sink block 92 in order to bias the block toward the wall 40. The heat sink block 92 and the printhead 16 connected thereto are freely pivotable about the shaft 90 so that the printhead is allowed to pivot to an orientation parallel with the plane of the print media as the printhead is brought into contact therewith. The heat sink block 92 is conventional and is provided to dissipate heat that is generated in the printhead 16.

With reference to FIG. 3, the details of the connection between the printhead 16 and the heat sink block 92 are illustrated. The printhead 16 includes a pair of threaded holes 98 that are aligned with non-threaded holes 100 formed through the heat sink block. A pair of threaded mounting screws 102 extend through non-threaded holes 104 in a clamp plate 106, through the holes 100, and into threaded engagement with the holes 98, thereby securing a central area of the printhead to the heat sink block. As stated previously, the printhead 16 is preferably a thermal printhead. Typically, a thermal printhead is slightly curved or dished due to the manufacture thereof, and thus it is necessary to eliminate the curvature from the thermal printhead 16 to ensure a proper printing operation on the print media. In order to flatten the printhead 16, a pair of threaded set screws 108 extend into threaded holes 110 formed through the heat sink block 92 and then into engagement with top and bottom ends of the printhead, thereby applying outward forces to the ends of the printhead, causing it to flatten. By adjusting the position of the set screws 108, the force that is applied to the ends of the printhead can be adjusted. Therefore, since the printhead is prone to wear and needs to be periodically replaced with a replacement printhead, which might have a different curvature than the original printhead, the set screws permit use of such a replacement printhead by ensuring that the replacement printhead can be flattened.

The clamp plate 106 further includes a threaded hole 112 between the two holes 104, and a threaded clamp screw 114 is engaged with the hole 112 and contacts an area of the heat sink block 92 between the holes 100. The clamp screw 114 locks the printhead 16 in position on the heat sink block 92 once the screws 102 secure the center of the printhead.

As stated previously, the printhead 16 is prone to wear and therefore needs periodic replacement. This can be easily accomplished with the present invention by removing the heat sink block and printhead as a unit from the pivot shaft 90. A new heat sink block and printhead unit can then be reassembled onto the pivot shaft 90. In order to maintain the precise location of the heat sink block and printhead unit relative to the assembly 18 when the unit is reassembled, a pair of reference buttons 116 are secured to the wall 40. The reference buttons 116 are securely fixed to the wall 40 and engage the side of the heat sink block 92. Once the desired position of the printhead is achieved using the adjusting features previously described herein, the reference buttons 116 provide a reference of the proper orientation of the printhead, such that when the heat sink block and replacement printhead are reassembled onto the pivot shaft, the correct orientation of the printhead is maintained, without requiring additional adjustments to be made.

It is to be understood that while certain embodiments of the present invention have been illustrated and described, the invention is not limited to the specific forms or arrangements of the parts described and shown.

I claim:

1. A printhead assembly, comprising:

a support base;

a slide assembly slideably disposed on said support base, said slide assembly being translatable along a linear path defining a first axis that is generally parallel to the support base;

an actuating mechanism engaged with the slide assembly for selectively translating the slide assembly along the linear path;

a printhead mounted on said slide assembly and moveable therewith a first adjustment mechanism operatively engaged with the printhead to rotate the printhead relative to the slide assembly about a second axis that is generally parallel to the first axis;

a second adjustment mechanism operatively engaged with the printhead to translate the printhead relative to the slide assembly along a third axis that is generally perpendicular to the first axis.

2. The printhead assembly according to claim 1, wherein the slide assembly includes a rack mounted thereon, and said actuating mechanism comprises a pinion gear driveably engaged with the rack.

3. The printhead assembly according to claim 1, further comprising a printhead support assembly connected to said slide assembly, and said printhead is pivotally mounted on said printhead support assembly.

4. The printhead assembly according to claim 3, further including a pivot shaft connected to said printhead support assembly and extending along a horizontal axis generally perpendicular to said linear path, and said printhead is mounted on said pivot shaft and is pivotable thereabout.

5. The printhead assembly according to claim 3, wherein said printhead support assembly comprises first and second portions, and said first adjustment mechanism is constructed so as to adjust the first portion relative to the second portion about a horizontal axis that is parallel to the linear path.

6. The printhead assembly according to claim 5, wherein said second adjustment mechanism is constructed so as to adjust the first portion and the second portion relative to the slide assembly along a vertical axis.

7. The printhead assembly according to claim 6, further comprising means for biasing the first portion in one direction about the horizontal axis relative to the second portion.

8. The printhead assembly according to claim 7, further comprising means for biasing the first and second portions in one direction along the vertical axis relative to said slide assembly.

9. The printhead assembly according to claim 5, further comprising at least one reference button connected to the first portion for ensuring precise location of the printhead on the printhead support assembly.

10. The printhead assembly according to claim 5, further comprising means for applying a preload to said second portion, said means for applying a preload being connected to said slide assembly.

11. The printhead assembly according to claim 1, further comprising a heat sink block, and said printhead is a thermal printhead and is connected to said heat sink block; and further including means for adjusting the printhead relative to the heat sink block.

12. The printhead assembly according to claim 11, wherein said printhead includes top and bottom portions and said means for adjusting the printhead comprises a pair of set screws, said set screws being engageable with the top and bottom portions of the printhead.

13. The printhead assembly according to claim 1, wherein the support base, the slide assembly, the actuating mechanism and the printhead include an assembled configuration, and the printhead is adjustable by said first and second adjustment mechanisms about said second and third axes, respectively, in the assembled configuration.

* * * * *